US010788768B2

(12) United States Patent
Morimoto et al.

(10) Patent No.: US 10,788,768 B2
(45) Date of Patent: Sep. 29, 2020

(54) CHARGING DEVICE, IMAGE FORMER, AND IMAGE FORMING APPARATUS THAT ELECTRICALLY CHARGE A SURFACE OF A CHARGING TARGET MEMBER

(71) Applicant: Oki Data Corporation, Tokyo (JP)

(72) Inventors: Daiki Morimoto, Tokyo (JP); Yasuhito Annaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/656,814

(22) Filed: Oct. 18, 2019

(65) Prior Publication Data

US 2020/0209778 A1 Jul. 2, 2020

(30) Foreign Application Priority Data

Dec. 27, 2018 (JP) ..... 2018-245408

(51) Int. Cl.
*G03G 15/02* (2006.01)
*G03G 15/20* (2006.01)

(52) U.S. Cl.
CPC ..... *G03G 15/0233* (2013.01); *G03G 15/0225* (2013.01); *G03G 15/2064* (2013.01); *G03G 2215/021* (2013.01)

(58) Field of Classification Search
CPC ..... G03G 15/0225; G03G 15/0233
USPC ..... 399/100, 176
See application file for complete search history.

(56) References Cited

U.S. PATENT DOCUMENTS 9,442,408 B2 * 9/2016 Yamauchi et al. ..... G03G 15/0233
9,921,513 B2 * 3/2018 Masu et al. ..... G03G 15/0233

FOREIGN PATENT DOCUMENTS

JP 2015090409 A 5/2015

* cited by examiner

*Primary Examiner* — William J Royer
(74) *Attorney, Agent, or Firm* — Rabin & Berdo, P.C.

(57) ABSTRACT

A charging device includes a charging member and a cleaning member. The charging member electrically charges a surface of a charging target member and is rotatable while being in contact with the surface of the charging target member. The cleaning member is in contact with a surface of the charging member and removes a foreign object attached to the surface of the charging member. Surface free energy of the surface of the charging member is 5.00 dynes per centimeter or more. A dynamic friction coefficient of the surface of the charging member and a surface of the cleaning member falls within a range from 0.48 to 0.88 both inclusive. The surface free energy and the dynamic friction coefficient satisfy a relation represented by the following expression (1).

$$E \leq -63\mu + 69 \quad (1)$$

"E" is the surface free energy in dynes per centimeter, and "μ" is the dynamic friction coefficient.

7 Claims, 4 Drawing Sheets

CHARGING DEVICE, IMAGE FORMER, AND IMAGE FORMING APPARATUS THAT ELECTRICALLY CHARGE A SURFACE OF A CHARGING TARGET MEMBER

CROSS REFERENCE TO RELATED APPLICATIONS

The present application claims priority from Japanese Patent Application No. 2018-245408 filed on Dec. 27, 2018, the entire contents of which are hereby incorporated by reference.

BACKGROUND

The technology relates to a charging device that electrically charges a surface of a charging target member, an image former provided with the charging device, and an image forming apparatus provided with the charging device.

An electrophotographic image forming apparatus is in widespread use. One reason for this is that the electrophotographic image forming apparatus allows a high-quality image to be obtained in a short time, as compared with an image forming apparatus of other method such as an inkjet method.

The electrophotographic image forming apparatus, hereinafter simply referred to as an "image forming apparatus," includes an image former that performs a charging process and a developing process. The image former may form an electrostatic latent image on a surface of a photosensitive member by electrically charging the surface of the photosensitive member, and thereafter attach a toner to the electrostatic latent image. The image former therefore includes a charging device. The charging device includes a charging member that electrically charges the surface of the photosensitive member.

A configuration of a charging device influences a charging state of a surface of a photosensitive member, and accordingly influences quality of an image formed with use of an electrostatic latent image. Various considerations have been therefore given to the configuration of the charging device. For example, in order to electrically charge the surface of the photosensitive member uniformly, a charging member or a charging roller of a contact-charging type is used. For example, reference can be made to Japanese Unexamined Patent Application Publication No. 2015-090409. The charging roller rotates while being in contact with the photosensitive member and thereby electrically charges the surface of the photosensitive member.

SUMMARY

Although various proposals have been made regarding a configuration of a charging device to be mounted on an image forming apparatus or an image former, the configuration of the charging device is still insufficient from a viewpoint of ensuring quality of an image, leaving room for improvement.

It is desirable to provide a charging device, an image former, and an image forming apparatus that are capable of forming a high-quality image.

According to one embodiment of the technology, there is provided a charging device that includes a charging member and a cleaning member. The charging member electrically charges a surface of a charging target member and is rotatable while being in contact with the surface of the charging target member. The cleaning member is in contact with a surface of the charging member and removes a foreign object attached to the surface of the charging member. Surface free energy of the surface of the charging member is 5.00 dynes per centimeter or more. A dynamic friction coefficient of the surface of the charging member and a surface of the cleaning member falls within a range from 0.48 to 0.88 both inclusive. The surface free energy and the dynamic friction coefficient satisfy a relation represented by the following expression (1), $$E \leq -63\mu + 69 \quad (1)$$

where "E" is the surface free energy in dynes per centimeter, and "μ" is the dynamic friction coefficient.

According to one embodiment of the technology, there is provided an image former that includes a developing device and a charging device. The developing device includes a photosensitive member and performs a developing process with use of a toner. The charging device performs a charging process on a surface of the photosensitive member. The charging device includes a charging member and a cleaning member. The charging member electrically charges the surface of the photosensitive member and is rotatable while being in contact with the surface of the photosensitive member. The cleaning member is in contact with a surface of the charging member and removes a foreign object attached to the surface of the charging member. Surface free energy of the surface of the charging member is 5.00 dynes per centimeter or more. A dynamic friction coefficient of the surface of the charging member and a surface of the cleaning member falls within a range from 0.48 to 0.88 both inclusive. The surface free energy and the dynamic friction coefficient satisfy a relation represented by the following expression (1), $$E \leq -63\mu + 69 \quad (1)$$

where "E" is the surface free energy in dynes per centimeter, and "μ" is the dynamic friction coefficient.

According to one embodiment of the technology, there is provided an image forming apparatus that includes an image former, a transfer section, and a fixing section. The image former performs a charging process and a developing process. The transfer section performs a transfer process with use of a toner subjected to the developing process by the image former. The fixing section performs a fixing process with use of the toner subjected to the transfer process by the transfer section. The image former includes a developing device and a charging device.

The developing device includes a photosensitive member and performs a developing process with use of a toner. The charging device performs a charging process on a surface of the photosensitive member. The charging device includes a charging member and a cleaning member. The charging member electrically charges the surface of the photosensitive member and is rotatable while being in contact with the surface of the photosensitive member. The cleaning member is in contact with a surface of the charging member and removes a foreign object attached to the surface of the charging member. Surface free energy of the surface of the charging member is 5.00 dynes per centimeter or more. The dynamic friction coefficient of the surface of the charging member and a surface of the cleaning member falls within a range from 0.48 to 0.88 both inclusive. The surface free energy and the dynamic friction coefficient satisfy a relation represented by the following expression (1), $$E \leq -63\mu + 69 \quad (1)$$

where "E" is the surface free energy in dynes per centimeter, and "μ" is the dynamic friction coefficient.

DETAILED DESCRIPTION

Figure 1:
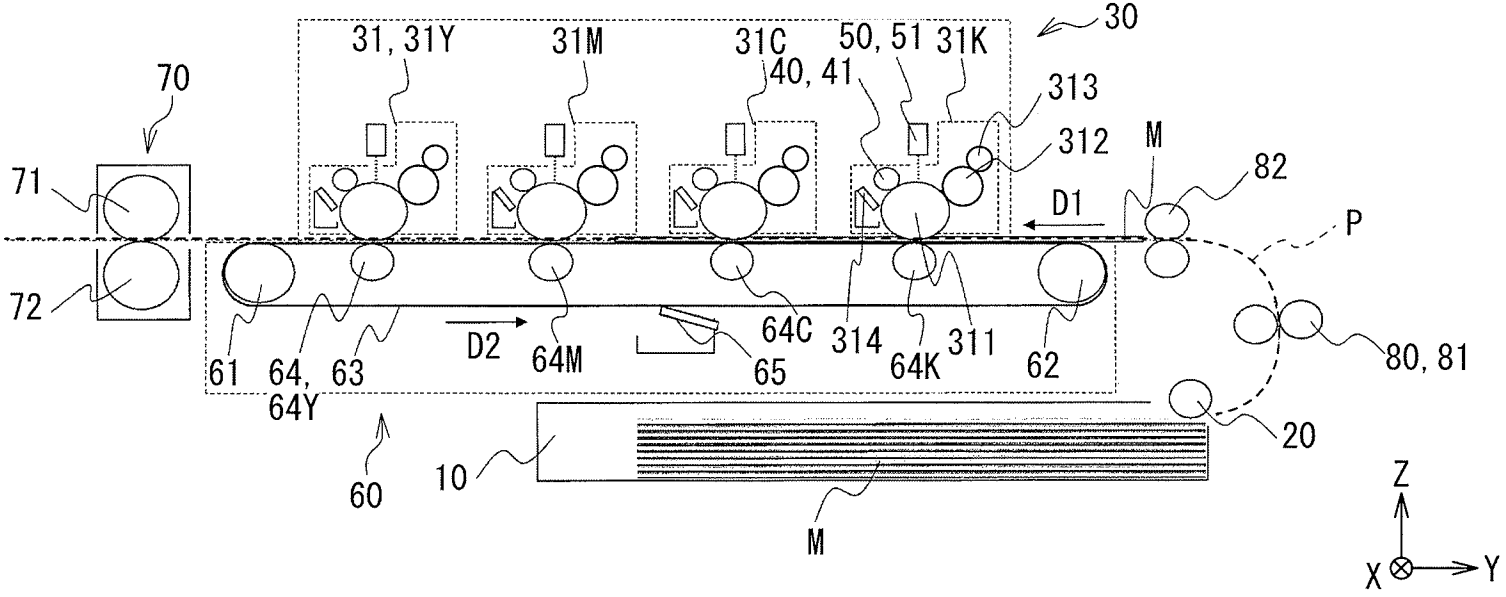
FIG. 1 is a plan view of an example of a configuration of an image forming apparatus according to an embodiment of the technology.

Some example embodiments of the technology are described below in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail. The description is given in the following order.

1. Image Forming Apparatus (Image Former and Charging Device)
   - 1-1. Configuration
     - 1-1-1. Overall Configuration
     - 1-1-2. Block Configuration
     - 1-1-3. Detailed Configuration of Charging Device
   - 1-2. Operation
   - 1-3. Example Workings and Example Effects
2. Modification Examples

1. Image Forming Apparatus (Image Former and Charging Device)

Description is given first of an image forming apparatus according to an example embodiment of the technology. Since each of an image former according to an example embodiment of the technology and a charging device according to an example embodiment of the technology is a portion, or one component, of the image forming apparatus, the image former and the charging device are described together below.

[1-1. Configuration]

For example, an image forming apparatus described below may form an image on a print medium M with use of toners of two or more colors, as will be described later. The image forming apparatus may be, for example, a so-called electrophotographic full-color printer (see FIG. 1.) The image forming apparatus may employ, for example, a direct transfer method that uses no intermediate transfer medium to form an image on the print medium M.

The print medium M is not particularly limited in its type; however, the print medium may be, for example, one or more of paper, a film, and any other printable medium. Specific but non-limiting examples of the print medium M as the paper may include plain paper, copy paper, special paper, and an envelope. Specific but non-limiting examples of the print medium M as the film may include an overhead projector (OHP) sheet.

[1-1-1. Overall Configuration]

FIG. 1 illustrates an example of a planar configuration of the image forming apparatus. As illustrated in FIG. 1, the image forming apparatus may include, for example, a cassette 10, a hopping roller 20, a developing section 30, a charging section 40, an exposure section 50, a transfer section 60, a fixing section 70, and a conveying roller 80. The image forming apparatus may convey the print medium M in a conveyance direction D1 along a conveyance path P indicated by a dashed line. The developing section 30 and the charging section 40 may correspond to an "image former" in one specific but non-limiting embodiment of the technology. The developing section 30 may correspond to a "developing device" in one specific but non-limiting embodiment of the technology. The charging section 40 may correspond to a "charging device" in one specific but non-limiting embodiment of the technology.

A series of rollers described below, i.e., a series of components including a term "roller" in their names, may each be a cylindrical member that extends in a direction intersecting a paper plane of FIG. 1, i.e., an X-axis direction, and is rotatable about a rotational axis extending in the X-axis direction.

[Cassette and Hopping Roller]

The cassette 10 may be, for example, an accommodation member that accommodates the print medium M. The cassette 10 may be attachable and detachable. The cassette 10 may accommodate two or more print medium M stacked on each other, for example. The hopping roller 20 may be a feeding member, or a print medium feeding roller, that feeds the print medium M to the conveyance path P by picking up the print medium M from the cassette 10.

[Developing Section]

The developing section 30 performs a developing process with use of a toner. In one specific but non-limiting example, the developing section 30 may use Coulomb force and thereby attach the toner to a surface of a photosensitive drum 311 that has been subjected to a charging process by the charging section 40, for example. The photosensitive drum 311 will be described later. In a more specific but non-limiting example, the developing section 30 may thus attach the toner to an electrostatic latent image formed on the surface of the photosensitive drum 311. The photosensitive drum 311 may correspond to a "charging target member" and a "photosensitive member" in one specific but non-limiting embodiment of the technology.

The developing section 30 may include a developing process unit 31 that performs the developing process. The developing process unit 31 may include, for example, the above-described photosensitive drum 311, a developing roller 312, a feeding roller 313, and a cleaning blade 314.

The photosensitive drum 311 may be a cylindrical member that extends in the X-axis direction, and may be rotatable about a rotational axis extending in the X-axis direction. The photosensitive drum 311 may be, for example, an organic photosensitive member that includes a cylindrical electrically-conductive shaft and a photoconductive layer. The electrically-conductive shaft may extend in the X-axis direction. The photoconductive layer may cover an outer peripheral surface of the electrically-conductive shaft.

The electrically-conductive shaft may be, for example, a metal pipe that includes one or more of metal materials such as aluminum or stainless steel. The photoconductive layer may include, for example, charge generation layers and charge transport layers that are alternately stacked on each other. The photoconductive layer may include any other layer, for example. The charge generation layer may include, for example, a charge generation substance and binder resin. The charge generation layer may include any other material, for example. The charge transport layer may include, for example, a charge transport substance and binder resin. The charge transport layer may also include various additives such as an antioxidant or a sensitizer on an as-needed basis. The charge transport layer may include any other material, for example.

The charge generation substance may include, for example, one or more of materials such as an organic pigment or an organic dye. Other than the above, non-limiting examples of the charge generation substance may include metal-free phthalocyanine, copper, indium chloride, gallium chloride, oxytitanium, metal, an oxide of the metal, and an azo pigment. Non-limiting examples of the metal may include tin, zinc, and vanadium. Non-limiting examples of the azo pigment may include monoazos, hisazos, trisazos, and polyazos. The binder resin may include, for example, one or more of polymer materials. Non-limiting examples of the polymer materials may include polyester, polyvinyl acetate, polyacrylate ester, polymethacrylate ester, polycarbonate, polyvinyl acetoacetal, polyvinylpropional, polyvinyl butyral, phenoxy resin, epoxy resin, urethane resin, cellulose ester, and cellulose ether.

The charge transport substance may include, for example, one or more of electron donating substances. Non-limiting examples of the electron donating substances may include a heterocyclic compound, an aniline derivative, a hydrazone compound, an aromatic amine derivative, and a stilbene derivative. Non-limiting examples of the heterocyclic compound may include carbazole, indole, imidazole, oxazole, pyrazole, oxadiazole, pyrazoline, and thiadiazole. It is to be noted that the charge transport substance may be, for example, a polymer having a group containing the above-described electron donating substance in a main chain or a side chain. The binder resin may include, for example, one or more of polymer materials. Non-limiting examples of the polymer materials may include polycarbonate, polymethyl methacrylate, polystyrene, a vinyl polymer, polyester, polyester carbonate, polysulfone, polyimide, phenoxy resin, epoxy resin, and silicone resin. Non-limiting examples of the vinyl polymer may include polyvinyl chloride. It is to be noted that the binder resin may be, for example, a polymer of any two or more of the above-described series of polymer materials or a partially-cross-linked cured product of any two or more of the above-described series of polymer materials.

The developing roller 312 may be in contact with the photosensitive drum 311. The developing roller 312 may attach the toner to an electrostatic latent image formed on the photosensitive drum 311. The developing roller 312 may include, for example, a metallic cylindrical shaft and an electrically-semiconductive urethane rubber layer. The electrically-semiconductive urethane rubber layer may cover an outer peripheral surface of the shaft.

The feeding roller 313 may be in contact with the developing roller 312. The feeding roller 313 may feed the toner discharged from an unillustrated toner cartridge to the developing roller 312. The cleaning blade 314 may be a plate-shaped member that is in contact with the photosensitive drum 311. The cleaning blade 314 may scrape off a foreign object on the surface of the photosensitive drum 311. The foreign object may be, for example but not limited to, an unnecessary remaining of the toner on the surface of the photosensitive drum 311. The cleaning blade 314 may include one or more of flexible materials. Non-limiting examples of the flexible materials may include a rubber material and a polymer material.

In the example embodiment, the developing section 30 may include, for example, four developing process units 31 (i.e., developing process units 31Y, 31M, 31C, and 31K.) The developing process units 31Y, 31M, 31C, and 31K may be disposed in this order from downstream side to upstream side in the conveyance direction D1, for example. The developing process units 31Y, 31M, 31C, and 31K may have respective configurations similar to each other except that types, e.g., colors, of toners used in the developing process differ from each other, for example. In one specific but non-limiting example, the developing process unit 31Y may be mounted with a yellow toner. The developing process unit 31M may be mounted with a magenta toner, for example. The developing process unit 31C may be mounted with a cyan toner, for example. The developing process unit 31K may be mounted with a black toner, for example.

The toner may include, for example, a toner base particle and an external additive. The toner base particle may include a material such as a colorant, binder resin, a mold release agent, or a charge control agent. The external additive may be fixed to a surface of the toner base particle. The agent such as the colorant, the mold release agent, or the charge control agent is a so-called inside additive included inside the toner base particle. In contrast, the external additive is an additive to be added on outer side of the toner base particle. The colorant may include one or more of materials such as a pigment or a dye each having a color corresponding to the color of the toner. The binder resin may include, for example, one or more of polymer materials such as polyester. The external additive may be, for example, a plurality of inorganic particles that prevents the toner from aggregating. The inorganic particles may include, for example, one or more of silicon dioxide (silica) particles, titanium oxide particles, and any other suitable particles. The toner is not particularly limited in its degree of circularity; however, the degree of circularity of the toner may fall within a range from about 0.94 to about 0.98 both inclusive, for example. The toner is not particularly limited in its average particle size (median size D50); however, the average particle size of the toner may be, for example, about 7 μm. The external additive including a plurality of particles is not particularly limited in its average particle size (median size D50); however, the average particle size of the external additive may fall within a range from about 50 nm to about 200 nm both inclusive, for example.

[Charging Section]

The charging section 40 performs a charging process on the surface of the photosensitive drum 311. In one specific but non-limiting example, the charging section 40 may electrically charge the surface of the photosensitive drum 311 uniformly in order to form an electrostatic latent image on the surface of the photosensitive drum 311. The charging section 40 may be disposed, for example, for each of the developing process units 31. The charging section 40 may include a charging roller 41 that electrically charges the surface of the photosensitive drum 311. A detailed configuration of the charging section 40 will be described later with reference to FIG. 3. The charging roller 41 may correspond to a "charging member" in one specific but non-limiting embodiment of the technology.

[Exposure Section]

The exposure section 50 may perform an exposure process by means of exposure light. In one specific but non-limiting example, the exposure section 50 may form an electrostatic latent image on the surface of the photosensitive drum 311, for example, by applying the exposure light to the surface, of the photosensitive drum 311, that has been electrically charged by the charging section 40.

The exposure section 50 may be disposed, for example, for each of the developing process units 31. The exposure section 50 may include a light source 51. Non-limiting examples of the light source 51 may include a light emitting diode (LED) and a laser device. Other than the above, the exposure section 50 may also include, for example, a component such as a lens array that forms an image of the exposure light on the surface of the photosensitive drum 311. In the example embodiment, the image forming apparatus may include, for example, four exposure sections 50 corresponding to the four developing process units 31, i.e., the developing process units 31Y, 31M, 31C, and 31K.

[Transfer Section]

The transfer section 60 performs a transfer process with use of the toner that has been subjected to the developing process by the developing section 30. In one specific but non-limiting example, the transfer section 60 may transfer, onto the print medium M, the toner attached to the electrostatic latent image.

The transfer section 60 may include, for example, a driving roller 61, an idler roller 62, a transfer belt 63, a transfer roller 64, and a cleaning blade 65.

The driving roller 61 may be rotatable by means of a drive source such as a motor, for example. The idler roller 62 may be rotatable in accordance with the rotation of the driving roller 61, for example. The transfer belt 63 may be, for example, an endless belt. The transfer belt 63 may travel in a travel direction D2 in accordance with the rotation of the driving roller 61 while lying on the driving roller 61 and the idler roller 62 and being stretched by the driving roller 61 and the idler roller 62, for example.

The transfer roller 64 may be in contact with the photosensitive drum 311 with the transfer belt 63 in between. The transfer roller 64 may transfer, onto the print medium M, the toner attached to the electrostatic latent image. In the example embodiment, the transfer section 60 may include, for example, four transfer rollers 64, i.e., transfer rollers 64Y, 64M, 64C, and 64K, corresponding to the four developing process units 31, i.e., the developing process units 31Y, 31M, 31C, and 31K. The cleaning blade 65 may be, for example, a plate-shaped member that is in contact with a surface of the transfer belt 63. The cleaning blade 65 may scrape off a foreign object on the surface of the transfer belt. The foreign object may be, for example, an unnecessary remaining of the toner attached to the surface of the transfer belt 63.

[Fixing Section]

The fixing section 70 performs a fixing process with use of the toner that has been subjected to the transfer process by the transfer section 60. In one specific but non-limiting example, the fixing section 70 may fix the toner to the print medium M by, for example, applying pressure to the print medium M provided with the transferred toner while heating the print medium M.

The fixing section 70 may include, for example, a heating roller 71 and a pressure-applying roller 72. The heating roller 71 may include a heat source built in the heating roller 71. Non-limiting examples of the heat source may include a halogen lamp. The heating roller 71 may heat the print medium M on which the toner has been transferred. The pressure-applying roller 72 may be in contact with the heating roller 71. The pressure-applying roller 72 may apply pressure to the print medium M on which the toner has been transferred.

[Conveying Roller]

The conveying roller 80 may convey the print medium M along the conveyance path P. The conveying roller 80 may include, for example, a pair of rollers opposed to each other with the conveyance path P in between. In one example embodiment, the image forming apparatus may include, for example, two conveying rollers 80, i.e., conveying rollers 81 and 82. Since the conveying roller 80 is, however, not limited in its number, any number of conveying rollers 80 may be provided.

[1-1-2. Block Configuration]

Figure 2:
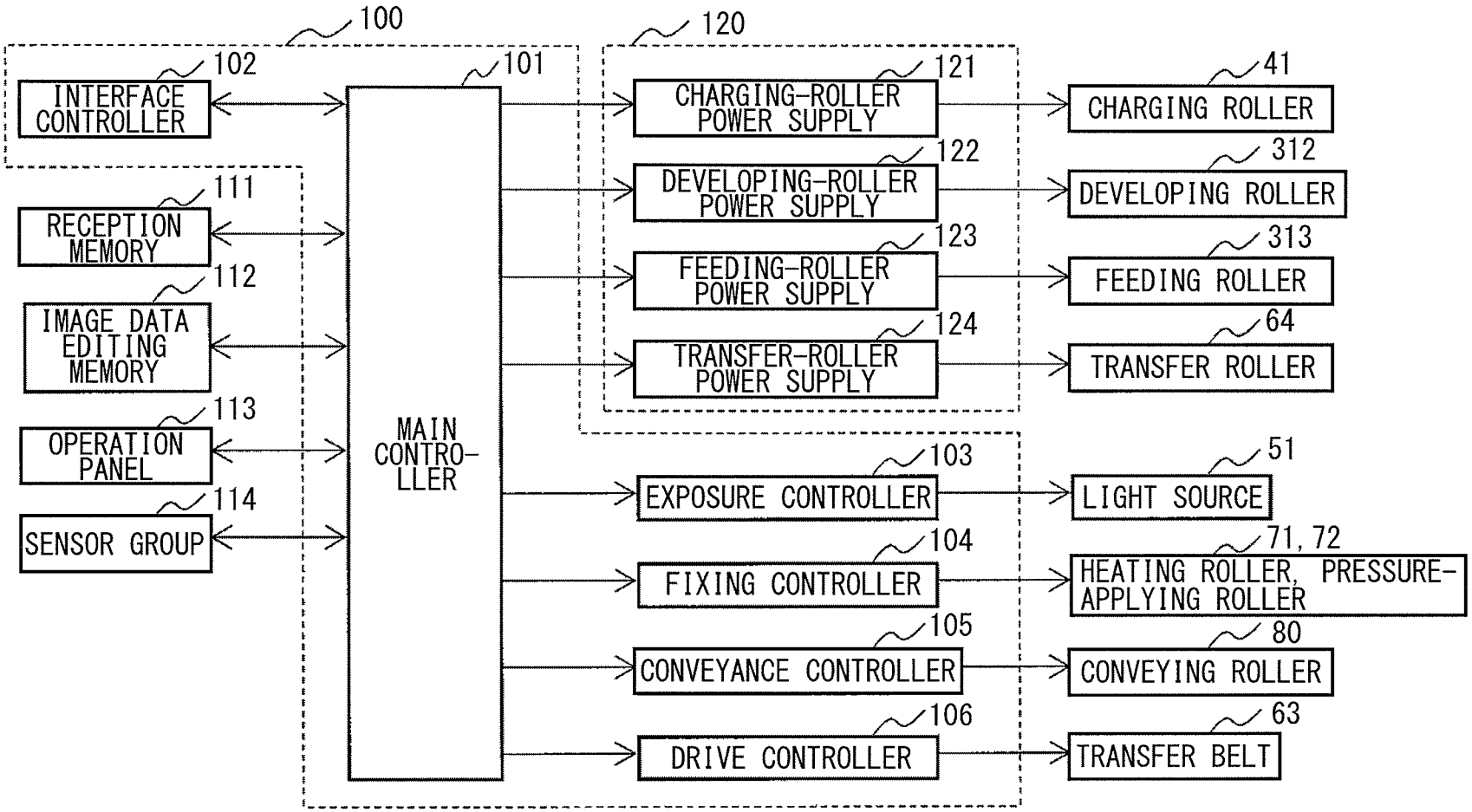
FIG. 2 is a block diagram illustrating an example of the configuration of the image forming apparatus.

FIG. 2 illustrates an example of a block configuration of the image forming apparatus. FIG. 2 also illustrates some of the components of the image forming apparatus already described above.

For example, as illustrated in FIG. 2, the image forming apparatus may include a controller 100, a reception memory 111, an image data editing memory 112, an operation panel 113, a sensor group 114, and a power supply circuit 120.

The controller 100 may control the image forming apparatus as a whole. The controller 100 may include, for example, one or more of electronic components such as a control circuit, a memory, an input-output port, or a timer. The control circuit may include, for example but not limited to, a central processing unit (CPU.) The memory may include one or more of memory devices such as a read-only memory (ROM) or a random-access memory (RAM.)

The controller 100 may include, for example, a main controller 101, an interface controller 102, an exposure controller 103, a fixing controller 104, a conveyance controller 105, and a drive controller 106. The main controller 101 may generally control operation of the image forming apparatus as a whole. The interface controller 102 may receive information supplied to the image forming apparatus from an external device. Non-limiting examples of the information may include image data. Non-limiting example of the external device may include a personal computer. The exposure controller 103 may control operation of the exposure section 50, e.g., the light source 51. The fixing controller 104 may control operation of the fixing section 70, e.g., the heating roller 71 and the pressure-applying roller 72. The conveyance controller 105 may control operation of the conveying roller 80. The drive controller 106 may control operation of the transfer section 60, e.g., the transfer belt 63.

The reception memory 111 may hold the information, such as the image data, supplied from the external device to the image forming apparatus. The image data editing memory 112 may hold, for example, the image data subjected to an editing process. The operation panel 113 may serve as a display device that displays information necessary for a user to operate the image forming apparatus. The operation panel 113 may also serve as an input device to be used by the user to operate the image forming apparatus. The operation panel 113 may include, for example, a component such as a display lamp, a display panel, or an operation button. Non-limiting examples of the display lamp may include an LED lamp. Non-limiting examples of the display panel may include a touch panel. The sensor group 114 may include, for example, one or more of sensors such as a temperature sensor, a humidity sensor, an image density sensor, a print medium position detection sensor, a toner remaining amount detection sensor, or a human presence sensor.

The power supply circuit 120 may include, for example, a charging-roller power supply 121, a developing-roller power supply 122, a feeding-roller power supply 123, and a transfer-roller power supply 124.

The charging-roller power supply 121 may apply a voltage to the charging roller 41. The developing-roller power supply 122 may apply a voltage to the developing roller 312. The feeding-roller power supply 123 may apply a voltage to the feeding roller 313. The transfer-roller power supply 124 may apply a voltage to the transfer roller 64.

[1-1-3. Detailed Configuration of Charging Device]

Figure 3:
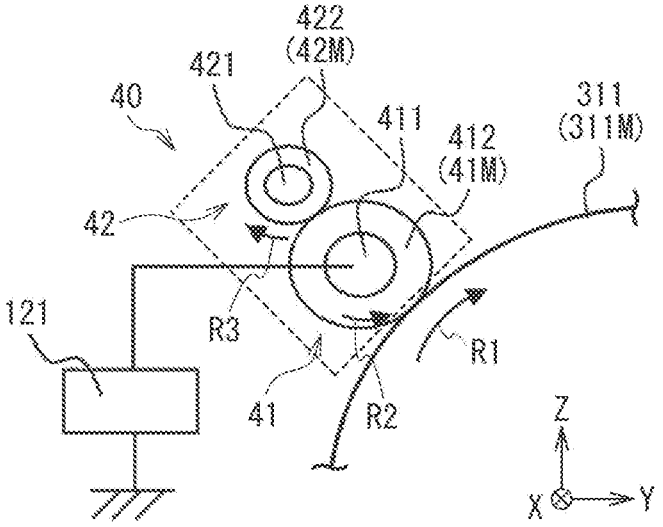
FIG. 3 is a plan view of an example of a configuration of a charging device.

FIG. 3 illustrates an example of a planar configuration of the charging section 40. FIG. 3 also illustrates a portion of the photosensitive drum 311 and the charging-roller power supply 121 together.

The charging section 40 may include the charging roller 41 and a cleaning roller 42, as illustrated in FIG. 3. The photosensitive drum 311 may include a surface 311M to be electrically charged by the charging section 40. The cleaning roller 42 may correspond to a "cleaning member" in one specific but non-limiting embodiment of the technology.

[Charging Roller]

The charging roller 41 may electrically charge the surface 311M of the photosensitive drum 311, as described above. The charging roller 41 may be in contact with the photosensitive drum 311. The charging roller 41 may include, for example, an electrically-conductive shaft 411 and an electrically-conductive elastic layer 412. The shaft 411 may be, for example, a metal core. The elastic layer 412 may correspond to a "first surface layer" in one specific but non-limiting embodiment of the technology.

As illustrated in FIG. 3, the shaft 411 may be a cylindrical member that extends in the X-axis direction. The shaft 411 may include one or more of metal materials. The shaft 411 may include any other material, for example. The metal material is not particularly limited in its type. Non-limiting examples of the metal material may include free-cutting steel (SUM) and stainless steel (SUS.) A surface of the shaft 411 may be plated with a metal material such as nickel by a plating method such as an electroless plating method, for example. The shaft 411 may be coupled to the charging-roller power supply 121. This may allow the charging-roller power supply 121 to apply a voltage to the shaft 411.

As illustrated in FIG. 3, the elastic layer 412 may cover an outer peripheral surface of the shaft 411. The elastic layer 412 may include a surface 41M that is in contact with the surface 311M of the photosensitive drum 311. The charging roller 41 or the elastic layer 412 may be rotatable about the shaft 411, serving as a rotational axis, in a rotation direction R2 while being in contact with the surface 311M of the photosensitive drum 311. The rotation direction R2 of the charging roller 41 may be opposite to a rotation direction R1 of the photosensitive drum 311. In one specific but non-limiting example, the rotation direction R2 may be a counterclockwise direction and the rotation direction R1 may be a clockwise direction. The elastic layer 412 may be, for example, a single layer or a multi-layer.

The elastic layer 412 may include, for example, one or more of polymer materials such as rubber or thermoplastic elastomer. Specific but non-limiting examples of the polymer material may include epichlorohydrin rubber (CO, ECO, GECO), ethylene propylene rubber (EPM, EPDM), acrylonitrile-butadiene rubber (NBR), hydrogenated acrylonitrile-butadiene rubber (H-NBR), styrene-butadiene rubber (SBR), butadiene rubber (BR), isoprene rubber (IR), chloroprene rubber (CR), urethane rubber, and silicone rubber. In one example embodiment, the polymer material may be a mixture of epichlorohydrin rubber (ECO) and acrylonitrile-butadiene rubber (NBR.) One reason is that this makes it easier for surface free energy E of the surface 41M of the charging roller 41 to be decreased appropriately, as will be described later.

In one example embodiment, electrical conductivity of the elastic layer 412 may be set in relation to appropriate electrical resistance. One reason for this is as follows. If the electrical resistance is excessively large, there is a possibility the surface 311M of the photosensitive drum 311 is charged non-uniformly or insufficiently. If the electrical resistance is excessively small, there is a possibility that a leakage current is generated due to a reason such as a scratch on the surface 311M of the photosensitive drum 311. Accordingly, in one example embodiment, the elastic layer 412 may include one or more of materials such as an ion conductive material, an ion conductive agent, carbon black, or a metal oxide to achieve a desired electrical conductivity. The electrical conductivity of the elastic layer 412 may be electronic conductivity or ionic conductivity. In one example embodiment, the elastic layer 412 may have ionic conductivity. One reason is that this suppresses variation in electrical resistance.

The elastic layer 412 is not particularly limited in its volume resistance; however, the volume resistance of the elastic layer 412 may fall within a range from $10^6\Omega$ to $10^9\Omega$. A value of the volume resistance varies depending on conditions such as temperature, humidity, or measurement voltage in a case where the elastic layer 142 has ionic conductivity; however, the value of the volume resistance described in the example embodiment is a value measured under environmental conditions with a temperature of 20° C. and humidity of 50% RH.

The elastic layer 412 is not particularly limited in its hardness; however, the hardness of the elastic layer 412 may fall within a range from 35° degrees to 80° both inclusive, for example. One reason is that this provides a fine gap between the surface 41M of the charging roller 41 and the surface 311M of the photosensitive drum 311, which ensures a region contributing to discharge based on Paschen's law, in other words, ensures an appropriate nip state. The hardness of the elastic layer 412 described above may be measured by peaks with use of a micro durometer MD-1capa (Type A) available from KOBUNSHI KEIKI CO., LTD. located in Kyoto, Japan. It is to be noted that the hardness of the elastic layer 412 may also serve to absorb a factor such as variation in a cylindrical shape of each of the charging roller 41 and the photosensitive drum 311. Therefore, the hardness of the elastic layer 412 may be settable to any value as long as the above-described appropriate nip state is obtained.

The elastic layer 412 may be formed by, for example, a process such as a cutting process, a polishing process, or a molding process. Therefore, a surface shape of the elastic layer 412 may be so adjusted as to have a desired polishing mark and desired surface roughness. The surface roughness, e.g., maximum height Ry according to Japanese Industrial Standards (JIS) B 0601: 1994, of the charging roller 41 or the elastic layer 412 may vary to some extent depending on conditions such as an applied voltage or a use environment. In one specific but non-limiting example, however, the surface roughness of the charging roller 41 or the elastic layer 412 may fall within a range from about 1 μm to about 40 μm both inclusive based on Paschen's law.

The elastic layer 412 may be subjected to a surface treatment. One reason is that this prevents the photosensitive drum 311 from being contaminated by the components in the elastic layer 412, and allows for adjustment of the surface resistance of the elastic layer 412. Another reason is that this prevents a material such as a toner or an external additive attached to the surface 311M of the photosensitive drum 311 from being attached to the surface 41M of the charging roller 41.

In one non-limiting example, the surface treatment may be an irradiation process such as an ultraviolet irradiation process or an electron beam irradiation process. In another non-limiting example, the surface treatment may be a coating process in which a coating solution is supplied to the surface 41M of the elastic layer 412 by means of a dipping process, spraying, a coater, or any other suitable method. The coating solution may include, for example, one or more of materials such as an isocyanate compound or polyol. Non-limiting examples of the isocyanate compound may include toluene diisocyanate (TDI), methylene diisocyanate (MDI), xylylene diisocyanate (XDI), naphthalene diisocyanate (NDI), hexamethylene diisocyanate (HDI), and isophorone diisocyanate (IPDI.) Non-limiting examples of the polyol may include polyester-based polyol, polycarbonate-based polyol, silicone-based polyol, acrylic-fluorine-based polyol, acrylic-silicone-based polyol, and fluorine-based polyol. The polyol may be, for example but not limited to, a multimer or a denaturant.

The coating solution may include an electrically-conductive material such as carbon black or an ionic conductive agent on an as-needed basis. The coating solution may include a plurality of particles on an as-needed basis. The particles may include, for example, one or more of polymer materials such as acrylic resin, urethane resin, fluororesin, polyamide resin, polycarbonate resin, polyester resin, or isocyanate resin.

In one example embodiment, since the coating solution includes fluororesin, the surface treatment may be performed on the elastic layer 412 with a coating solution including the fluororesin. In other words, in one example embodiment, the elastic layer 412 may include fluororesin. One reason is that this makes it easier for the surface free energy E of the surface 41M of the charging roller 41 to be decreased appropriately, as will be described later. The fluororesin is a generic term for resin, or a polymer material, that contains fluorine (F) as a constituent element. The fluororesin may include, for example, one or more of materials such as polytetrafluoroethylene (PTFE).

[Cleaning Roller]

The cleaning roller 42 may remove a foreign object attached to the surface 41M of the charging roller 41. The cleaning roller 42 may be in contact with the surface 41M of the charging roller 41. The cleaning roller 42 may remove the foreign object attached to the surface 41M of the charging roller 41 by winding up the foreign object while rotating. In one specific but non-limiting example, the cleaning roller 42 may include, for example, a shaft 421 and an elastic layer 422. The shaft 421 may be, for example, a core body. The elastic layer 422 may correspond to a "second surface layer" in one specific but non-limiting embodiment of the technology.

As illustrated in FIG. 3, the shaft 421 may be a cylindrical member that extends in the X-axis direction. The shaft 421 may include one or more of a metal material, a polymer material, and any other suitable material. The metal material is not particularly limited in its type. Non-limiting examples of the metal material may include free-cutting steel (SUM) and stainless steel (SUS.) The surface of the shaft 411 may be plated with a metal material such as nickel, for example, by an electroless plating method or any other suitable method. The polymer material is not particularly limited in its type. Non-limiting examples of the polymer material may include polyacetal (POM.)

For example, as illustrated in FIG. 3, the elastic layer 422 may cover an outer peripheral surface of the shaft 421. The elastic layer 422 may include a surface 42M that is in contact with the surface 41M of the charging roller 41. It is to be noted that, in one example, the elastic layer 422 may cover only a middle portion of the outer peripheral surface of the shaft 421, i.e., a portion excluding both ends of the outer peripheral surface of the shaft 421 in a longitudinal direction. In another example, the elastic layer 422 may spirally cover the outer peripheral surface of the shaft 421. The cleaning roller 42 or the elastic layer 422 may be rotatable about the shaft 421, serving as a rotational axis, in a rotation direction R3 while being in contact with the surface 41M of the charging roller 41, for example. The rotation direction R3 of the cleaning roller 42 may be opposite to the rotation direction R2 of the charging roller 41. In one specific but non-limiting example, the rotation direction R3 may be a clockwise direction and the rotation direction R4 may be a counterclockwise direction. The elastic layer 422 may be, for example, a single layer or a multi-layer. The elastic layer 422 may have, for example, a foamed structure, or may have a structure in which a solid layer and a foamed layer are stacked on each other.

The elastic layer 422 may include, for example, one or more of polymer materials such as foamable resin or a rubber material. The foamable resin is not particularly limited in its type. Non-limiting examples of the foamable resin may include polyurethane, polyethylene, polyamide, and polypropylene. The rubber material is not particularly limited in its type. Non-limiting examples of the rubber material may include silicone rubber, fluororubber, urethane rubber, ethylene propylene rubber (EPM, EDPM), acrylonitrile-butadiene rubber (NBR), hydrogenated acrylonitrile-butadiene rubber (H-NBR), styrene-butadiene rubber (SBR), butadiene rubber (BR), isoprene rubber (IR), and chloroprene rubber (CR.) The elastic layer 422 may include one or more of aids such as a foaming aid, a foam stabilizer, a catalyst, a curing agent, a plasticizer, or a vulcanization accelerator, on an as-needed basis.

In one example embodiment, the elastic layer 422 may include foamable resin having bubbles. One reason is that this makes it easier for a dynamic friction coefficient μ of the surface 41M of the charging roller 41 and the surface 42M of the cleaning roller 42 to be decreased appropriately, as will be described later. Accordingly, it is easier for the cleaning roller 42 or the elastic layer 422 to remove the foreign object attached to the surface 41M of the charging roller 41.

In one example embodiment, the elastic layer 422 may include foamable polyurethane or foamed polyurethane. One reason for this is as follows. The foamed polyurethane has resistance to tearing, pulling, etc. This makes it more difficult for the surface 41M of the charging roller 41 to be damaged, and also makes it more difficult for the charging roller 41 be damaged, for example, be teared.

The elastic layer 422 is not particularly limited in its density, e.g., density according to JIS K7222. For example, the density of the elastic layer 422 may fall within a range from 20 $kg/m^3$ to 80 $kg/m^3$ both inclusive. The elastic layer 422 is not particularly limited in its hardness, 25% compressive hardness according to JIS K6400-2. For example, the hardness of the elastic layer 422 may fall within a range from 100 N to 410 N both inclusive, for example. The elastic layer 422 is not particularly limited in its tensile strength, e.g., tensile strength according to JIS K6400-5. For example, the tensile strength of the elastic layer 422 may fall within a range from 60 kPa to 300 kPa both inclusive. The elastic layer 422 is not particularly limited in its elongation, e.g., elongation according to JIS K6400-5. For example, the elongation of the elastic layer 422 may fall within a range from 100% to 220% both inclusive.

[Physical Property]

In the charging section 40, a physical property of each of the charging roller 41 and the cleaning roller 42 may be so optimized as to make it more difficult for the external additive to be fixed to the surface 41M of the charging roller 41 and as to make it easier for the external additive adsorbed to the surface 41M of the charging roller 41 to be removed by the cleaning roller 42, when the external additive falls off from the toner.

Firstly, the surface free energy E (dyn/cm) of the surface 41M of the charging roller 41 or the elastic layer 412 is 5.00 dyn/cm or more. Secondly, the dynamic friction coefficient μ of the surface 41M of the charging roller 41 or the elastic layer 412 and the surface 42M of the cleaning roller 42 or the elastic layer 422 falls within a range from 0.48 to 0.88 both inclusive. Thirdly, the surface free energy E and the dynamic friction coefficient μ described above satisfy a relation represented by the following expression (1).

$$E \leq -63\mu + 69 \quad (1)$$

In the above-described expression (1), "E" is the surface free energy in dynes per centimeter, and "μ" is the dynamic friction coefficient.

One reason why the surface free energy E falls within the above-described range is that it allows the surface free energy E to be decreased appropriately, which in turn allows a polarity of the surface 41M of the charging roller 41 to be decreased appropriately. Accordingly, adsorption force of the external additive to the surface 41M is decreased. This makes it more difficult for the external additive to be fixed to the surface 41M. As a result, it is easier for the cleaning roller 42 to remove the external additive from the surface 41M of the charging roller 41.

One reason why the dynamic friction coefficient μ falls within the above-described range is that it allows the dynamic friction coefficient μ to be decreased appropriately, which in turn allows the force by which the surface 41M of the charging roller 41 and the surface 42M of the cleaning roller 42 are in sliding contact with each other to be decreased appropriately. This makes it more difficult for the cleaning roller 42 to rub the external additive on the surface 41M of the charging roller 41, and thereby makes it more difficult for the external additive to be deposited on the surface 41M. As a result, it is easier for the cleaning roller 42 to remove the external additive from the surface 41M of the charging roller 41.

One reason why the surface free energy E and the dynamic friction coefficient μ satisfy the relation represented by the expression (1) is that the relation between the surface free energy E and the dynamic friction coefficient μ is optimized. This makes it more difficult for the cleaning roller 42 to rub the external additive against the surface 41M of the charging roller 41 while the adsorption force of the external additive to the surface 41M is decreased. Accordingly, it is more difficult for the external additive to be fixed to the surface 41M. As a result, it is further easier for the cleaning roller 42 to remove the external additive from the surface 41M of the charging roller 41.

It is to be noted that the surface free energy E is not particularly limited as long as the surface free energy E is 5.00 dyn/cm or more. In one example embodiment, the surface free energy E may be 13.49 dyn/cm or less. One reason is that this allows polarity of the surface 41M of the charging roller 41 to be decreased sufficiently. This sufficiently decreases the adsorption force of the external additive to the surface 41M, which makes the external additive hardly fixed to the surface 41M. Accordingly, it is more difficult for the surface 41M of the charging roller 41 to be damaged due to contact or friction with the external additive. As a result, a life of the charging roller 41 is made longer.

In the example embodiment, a method of measuring the surface free energy E may be as follows. In a case of measuring the surface free energy E, a contact angle of the surface 41M of the charging roller 41 may be measured with use of three types of liquid samples described in Table 1. The three liquid samples may be water ($H_2O$), diiodomethane ($CH_2I_2$), and dodecane ($C_{12}H_{26}$.) Surface free energy components yd (dyn/cm), γp (dyn/cm), γh (dyn/cm), and γtotal (dyn/cm) related to the three liquid samples are as described in Table 1.

TABLE 1

| Liquid sample | γd (dyn/cm) | γP (dyn/cm) | γh (dyn/cm) | γtotal (dyn/cm) |
|---|---|---|---|---|
| Water | 29.1 | 1.3 | 42.4 | 72.8 |
| Diiodomethane | 46.8 | 4.0 | 0 | 50.8 |
| Dodecane | 25.4 | 0 | 0 | 25.4 |

In a case of measuring the contact angle, the contact angle may be measured under ambient temperature and ambient humidity environmental conditions with use of a contact angle meter by a drop method with a liquid volume in a range from $0.22\times10^{-3}$ ml to $0.27\times10^{-3}$ ml, i.e., a range from 0.22 $mm^3$ to 0.27 $mm^3$. The ambient temperature and ambient humidity environmental conditions may be, for example, at a temperature of 23±3° C. and at humidity of 55±10% RH. As the contact angle meter, for example, a contact angle meter of CA-X type available from Kyowa Interface Science Co., LTD. located in Saitama, Japan may be used. Thereafter, the surface free energy E may be calculated with use of an equation proposed by Kitazaki and Hata and a Young-Dupre equation on the basis of a result of the measurement of the contact angle.

Figure 4:
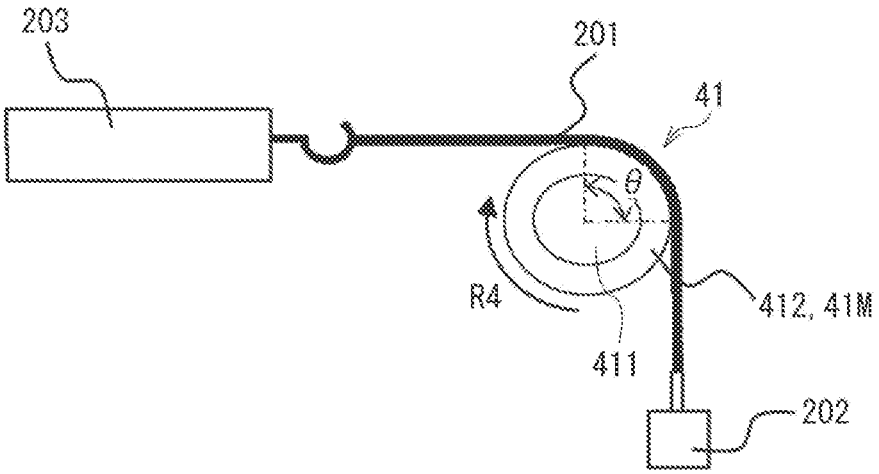
FIG. 4 is a plan view for explaining an example of a method of measuring a dynamic friction coefficient.

An example of a method of measuring the dynamic friction coefficient μ may be as follows. FIG. 4 illustrates an example of a planar configuration of components including the charging roller 41 in order to explain the method of measuring the dynamic friction coefficient μ. In the case of measuring the dynamic friction coefficient μ, Euler's belt formula may be used.

In one specific but non-limiting example, as illustrated in FIG. 4, after an inner surface of a belt 201 is brought into contact with the surface 41M of the charging roller 41 or the elastic layer 412, a first end of the belt 201 may be coupled to a weight 202, and a second end of the belt 201 may be coupled to a load meter 203. In this case, a winding angle, i.e., an angle at which the inner surface of the belt 201 is wound around the surface 41M of the charging roller 41 may be 0 (rad).

When the charging roller 41 is rotated at a predetermined rotational speed in a rotation direction R4 while causing the charging roller 41 to be in contact with the belt 201 in this state, the following relational expression (2) may be established between the winding angle θ (rad), a load W (gf) of the weight 202, force F (gf) measured by the load meter 203, and the dynamic friction coefficient μ of the surface 41M of the charging roller 41 and the inner surface of the belt 201.

$$\mu=(1/\theta)\ln(F/W) \quad (2)$$

In a case of measuring the dynamic friction coefficient μ of the surface 41M of the charging roller 41 and the surface 42M of the cleaning roller 42, the dynamic friction coefficient μ may be calculated with use of the belt 201. The belt 201 may include the same material as that of the elastic layer 422. In this case, the winding angle θ may be π/2 rad, a width of the belt 201 may be 7 mm, a thickness of the belt 201 may be 4 mm, the load W may be 50 gf, and the rotational speed of the charging roller 41, i.e., a speed at which the charging roller 41 slides against the belt 201 while being in contact with the belt 201, may be 1.0 mm/sec. After the force F is thereby measured with use of the load meter 203, the dynamic friction coefficient μ may be calculated with use of the relational expression (2).

[1-2. Operation]

The image forming apparatus may form an image on the print medium M by the following procedure, for example. In the following, reference is made where appropriate to FIGS. 1 to 3 which have already been described.

In a case of forming an image on the print medium M, when image data is transmitted from the external device to the image forming apparatus, the interface controller 102 may receive the image data. Thereafter, the image data may be stored in the reception memory 111, and image data subjected to an editing process may be stored in the image data editing memory 112.

In this case, the conveyance controller 105 may drive the conveying roller 80 and the hopping roller 20 may be thereby caused to pick up the print medium M from the cassette 10. Thereafter, the print medium M may be conveyed along the conveyance path P in the conveyance direction D1. Thereafter, the image forming apparatus may perform, for example, the charging process, the exposure process, the developing process, the transfer process, and the fixing process in this order as described below. The series of processes may be controlled by the controller 100 or the main controller 101.

[Charging Process]

First, in the charging section 40, when the charging-roller power supply 121 applies a voltage to the charging roller 41 or the shaft 411, the charging roller 41 may rotate while being in contact with the photosensitive drum 311. The charging roller 41 may thereby electrically charge the surface 311M of the photosensitive drum 311 uniformly. In this case, since the cleaning roller 42 rotates while being in contact with the charging roller 41, the foreign object attached to the surface 41M of the charging roller 41 may be removed by the cleaning roller 42.

[Exposure Process]

Thereafter, in the exposure section 50, the exposure controller 103 may drive the light source 51 and thereby cause the light source 51 to apply the exposure light to the surface 311M of the photosensitive drum 311 on the basis of the image data subjected to the editing process. As a result, an electrostatic latent image may be formed on the surface 311M of the photosensitive drum 311.

[Developing Process]

Thereafter, in the developing section 30 or the developing process unit 31, when the feeding-roller power supply 123 applies a voltage to the feeding roller 313 and the developing-roller power supply 122 applies a voltage to the developing roller 312, the feeding roller 313 may feed the toner to the surface of the developing roller 312, and the developing roller 312 may attach the toner to the electrostatic latent image. In this case, the foreign object such as an unnecessary remaining of the toner attached to the surface 311M of the photosensitive drum 311 may be scraped off by the cleaning blade 314.

[Transfer Process]

Thereafter, in the transfer section 60, when the drive controller 106 drives the transfer belt 63 and the transfer-roller power supply 124 applies a voltage to the transfer roller 64, the transfer belt 63 may travel in a travel direction D2 and the transfer roller 64 may be pressed against the photosensitive drum 311 with the transfer belt 63 in between. As a result, the toner attached to the electrostatic latent image may be transferred onto the print medium M. In this case, the foreign object such as the unnecessary remaining of the toner attached to the surface of the transfer belt 63 may be scraped off by the cleaning blade 65.

A combination of which of the four developing process units 31, i.e., the developing process units 31Y, 31M, 31C, and 31K and the four transfer rollers 64, i.e., the transfer rollers 64Y, 64M, 64C, and 64K to perform the developing process and transfer process may be determined on the basis of a combination of colors of the toners required to form the image.

[Fixing Process]

Thereafter, in the fixing section 70, the toner transferred onto the print medium M may be heated by the heating roller 71 while being applied with pressure by the pressure-applying roller 72. The toner may be thereby fixed to the print medium M. As a result, the image may be formed on the print medium M, and the image forming operation may be completed.

[1-3. Example Workings and Example Effects]

In the image forming apparatus according to the example embodiment of the technology, the surface free energy E of the surface 41M of the charging roller 41 or the elastic layer 412 in the charging section 40 is 5.00 dyn/cm or more, the dynamic friction coefficient μ of the surface 41M of the charging roller 41 and the surface 42M of the cleaning roller 42 or the elastic layer 422 in the charging section 40 falls within the range from 0.48 to 0.88 both inclusive, and the surface free energy E and the dynamic friction coefficient μ satisfy the relation represented by the expression (1). Accordingly, it is possible to form a high-quality image for the following reasons.

In a case where a toner in which an external additive, e.g. a plurality of inorganic particles, is fixed to a surface of a toner base particle, the external additive can fall off from the surface of the toner base particle. Examples of a possible cause of the external additive falling off from the surface of the toner base particle may include contact between the toners and contact between the toner and another object.

In this case, since the charging roller 41 is in contact with the photosensitive drum 311, when the external additive fallen off from the toner base particle is attached to the surface 311M of the photosensitive drum 311, it is easier for the external additive to be transferred or adsorbed from the surface 311M of the photosensitive drum 311 to the surface 41M of the charging roller 41. When the external additive is adsorbed to the surface 41M of the charging roller 41, charging may be insufficient, for example, a potential may drop in a region, of the surface 311M of the photosensitive drum 311, corresponding to the adsorption region of the external additive at a time of the charging process. This makes it easier for the toner to be attached unintentionally to the region where the charging is insufficient at the time of the developing process. One reason for this is that low electrical conductivity of the external additive makes it more difficult for the charging roller 41 to electrically charge the surface 311M of the photosensitive drum 311.

For such a reason, when the external additive is deposited on the surface 311M of the photosensitive drum 311, it is easier for an image defect to occur at a position corresponding to the adsorption region of the external additive in the image formed on the print medium M by the image forming apparatus. Non-limiting examples of the image defect may include a vertical streak and blurring each having a color corresponding to the type of toner attached to the region where the charging is insufficient. Such an image defect may be an image quality defect resulting independently of the image data, e.g., a formation pattern of the electrostatic latent image.

Therefore, in order to suppress the occurrence of the image defect in the image, it may be necessary to improve performance of the cleaning roller 42 cleaning the charging roller 41. That is, it may be necessary to make it more difficult for the external additive to be fixed to the surface 41M of the charging roller 41 or to remain on the surface 41M of the charging roller 41, when the external additive is attached to the surface 41M of the charging roller 41. It may be also necessary to make it easier for the cleaning roller 42 to remove the external additive from the surface 41M of the charging roller 41, when the external additive is attached to the surface 41M of the charging roller 41.

In this regard, in the image forming apparatus of the example embodiment, the surface free energy E is optimized to fall within the predetermined range, the dynamic friction coefficient μ is also optimized to fall within the predetermined range, and the surface free energy E and the dynamic friction coefficient μ are optimized to satisfy the predetermined relation, as described above.

In this case, since the surface free energy E is decreased appropriately as described above, the adsorption force of the external additive to the surface 41M of the charging roller 41 is decreased sufficiently, as compared with a case where the surface free energy E is not decreased appropriately. This makes it more difficult for the external additive to be fixed to the surface 41M. Accordingly, it is easier for the cleaning roller 42 to remove the external additive from the surface 41M of the charging roller 41.

Further, since the dynamic friction coefficient μ is decreased appropriately, it is more difficult for the cleaning roller 42 to rub the external additive against the surface 41M of the charging roller 41, even when the cleaning roller 42 rotates while being in contact with the charging roller 41, as compared with the case where the dynamic friction coefficient μ is not decreased appropriately. This makes it more difficult for the external additive to be fixed to the surface 41M. Accordingly, it is further easier for the cleaning roller 42 to remove the external additive from the surface 41M of the charging roller 41.

Further, since the surface free energy E and the dynamic friction coefficient μ satisfy the appropriate relation, one of the surface free energy E and the dynamic friction coefficient μ is optimized in a relation with the other. In this case, it is further easier for the cleaning roller 42 to remove the external additive from the surface 41M of the charging roller 41, as compared with the case where the surface free energy E and the dynamic friction coefficient μ do not satisfy the appropriate relation.

As described above, optimizing of the physical properties of the charging roller 41 and the cleaning roller 42, i.e., the surface free energy E, the dynamic friction coefficient μ, and the relation between the surface free energy E and the dynamic friction coefficient μ, makes it sufficiently easier for the cleaning roller 42 to remove the external additive from the surface 41M of the charging roller 41. Accordingly, it is more difficult for the image defect to occur in the image, which makes it possible to form a high-quality image.

Further, in the image forming apparatus according to one example embodiment, where the surface free energy E is 13.49 dyn/cm or less, the external additive is hardly fixed to the surface 41M of the charging roller 41. This makes it more difficult for the charging roller 41 to be damaged due to the contact between the charging roller 41 and the external additive. Accordingly, the life of the charging roller 41 is made longer and a high-quality image is formed more stably, which makes it possible to obtain a higher effect.

In one example embodiment where the elastic layer 412 of the charging roller 41 includes the fluororesin, it is easier for the surface free energy E to be decreased appropriately, which makes it possible to obtain a higher effect. In this case, in one example embodiment where the elastic layer 412 includes the mixture of epichlorohydrin rubber and acrylonitrile-butadiene rubber, it is further easier for the surface free energy E to be decreased, which makes it possible to obtain a further higher effect.

In one example embodiment where the elastic layer 422 of the cleaning roller 42 include foamed polyurethane, it is easier for the dynamic friction coefficient μ to be decreased appropriately, which makes it possible to obtain a higher effect.

The example workings and the example effects related to the image forming apparatus described above are similarly obtained in the charging section 40 corresponding to the charging device and in the developing section 30 and the charging section 40 corresponding to the image former.

2. Modification Examples

The configuration of the image forming apparatus described above are modifiable as appropriate. For example, as long as the surface free energy E falls within the above-described appropriate range, the elastic layer 412 does not necessarily include the mixture of epichlorohydrin rubber and acrylonitrile-butadiene rubber described above, and may include any other material. For example, as long as the dynamic friction coefficient μ falls within the above-described appropriate range, the elastic layer 422 does not necessarily include the foamed polyurethane described above, and may include any other material. It is also possible to obtain a similar effect in the above-described cases as long as the above-described appropriate condition is satisfied related to each of the surface free energy E, the dynamic friction coefficient μ, and the relation between the surface free energy E and the dynamic friction coefficient μ.

Although a rotatable member, e.g., the cleaning roller 42, may be used as the cleaning member in the above-described example embodiment, a non-rotatable member may be used as the cleaning member. Non-limiting examples of the non-rotatable member may include a sponge. It is also possible to obtain a similar effect in the above-described case as long as the above-described appropriate condition is satisfied related to each of the surface free energy E, the dynamic friction coefficient μ, and the relation between the surface free energy E and the dynamic friction coefficient μ.

WORKING EXAMPLES

Some working examples of an example embodiment of the technology are described in detail.

Experimental Examples 1 to 16

An image was formed on the print medium M with use of the image forming apparatus and quality of the image was evaluated thereafter by the following procedures.

[Preparation of Image Forming Apparatus, etc.]

The image forming apparatus provided with the charging section 40, the print medium M, and a toner, i.e., a cyan toner, were prepared. The charging section 40 included the charging roller 41 and the cleaning roller 42.

As the image forming apparatus, an electrophotographic full-color printer (a printer C542dnw available from Oki Data Corporation located in Tokyo, Japan) was used. As the print medium M, plain paper of A4 size was used.

The cyan toner included a cyan colorant (phthalocyanine blue), binder resin (amorphous polyester), a mold release agent (paraffin wax), a charge control agent, and an external additive (composite oxide particles, colloidal silica, and silica powder.)

As the cleaning roller 42, a roller was used in which the elastic layer 422 (foamed polyurethane, urethane foam moltopren SM-55 available from INOAC CORPORATION located in Aichi, Japan, having an outer diameter of 6 mm) was provided on an outer peripheral surface of the shaft 421 (free-cutting steel (SUM) plated with nickel by an electroless plating method and having an outer diameter of 4 mm).

As the charging roller 41, a roller fabricated by the following procedure was used. In a case of fabricating the charging roller 41, first, prepared was a roller precursor in which the elastic layer 412 (a rubber material whose main component was a mixture of epichlorohydrin-hydrolin rubber (ECO) and acrylonitrile-butadiene rubber (NBR), having an outer diameter of 9.5 mm) was prepared on an outer peripheral surface of the shaft 411 (free-cutting steel (SUM) plated with nickel by an electroless plating method and having an outer diameter of 6 mm). Thereafter, the surface 41M of the elastic layer 412 was dry-polished by a cylindrical polishing method by means of a grinder, while rotating the roller precursor. Thereafter, the surface 41M of the elastic layer 412 was wet-polished by a tape-polishing method.

Thereafter, 100 parts by mass of an organic solvent (ethyl acetate), 15 parts by mass of an isocyanate compound (hexamethylene diisocyanate (HDI)), and 0.3 parts by mass to 3 parts by mass of fluororesin (polytetrafluoroethylene (PTFE)) were mixed, and the organic solvent was stirred. A coating solution was thereby prepared.

Thereafter, the coating solution was applied to the surface 41M of the elastic layer 412 by an immersion method. Thereafter, the coating solution was dried. This caused the coating solution to penetrate into the elastic layer 412, and the coating solution was cured while the organic solvent was volatilized. The elastic layer 412 was thereby subjected to the surface treatment. As a result, the charging roller 41 was completed.

In this case, each of the surface free energy E and the dynamic friction coefficient μ was varied as described in Table 2 by changing the fabrication conditions of the charging roller 41. Specifically, firstly, a particle size of the tape used in the tape polishing method was varied, and a polishing rate at a time of polishing using the tape was varied. Secondly, surface roughness (maximum height Ry according to JIS B 0601: 1994) of the surface 41M of the elastic layer 412 was varied within a range from 1 μm to 25 μm. Thirdly, a concentration of the fluororesin in the coating solution was varied within a range from 0.3 parts by mass to 3 parts by mass. The method of measuring each of the surface free energy E and the dynamic friction coefficient μ was as described above.

Table 2 describes a value (=−63μ+69) of the surface free energy calculated by the expression (1), as a threshold defining the relation between the surface free energy E and the dynamic friction coefficient μ.

TABLE 2

| Experimental example | Surface free energy E (dyn/cm) | Dynamic friction coefficient μ | Threshold (−63μ + 69) | Quality | Smudge level |
|---|---|---|---|---|---|
| 1 | 13.49 | 0.79 | 19.23 | A | 5 |
| 2 | 12.02 | 0.48 | 38.76 | A | 5 |
| 3 | 12.49 | 0.68 | 26.16 | A | 5 |
| 4 | 8.32 | 0.87 | 14.19 | A | 5 |
| 5 | 13.49 | 0.88 | 13.56 | A | 5 |
| 6 | 27.34 | 0.65 | 28.05 | A | 4 |
| 7 | 38.03 | 0.49 | 38.13 | A | 4 |
| 8 | 24.68 | 0.49 | 38.13 | A | 3 |
| 9 | 5.00 | 0.82 | 17.34 | A | 5 |
| 10 | 32.09 | 0.65 | 28.05 | B | — |
| 11 | 27.31 | 0.82 | 17.34 | B | — |
| 12 | 53.55 | 1.73 | −39.99 | B | — |
| 13 | 45.05 | 1.63 | −33.69 | B | — |
| 14 | 19.19 | 1.32 | −14.16 | B | — |
| 15 | 51.55 | 1.75 | −41.25 | B | — |
| 16 | 60.51 | 1.39 | −18.57 | B | — |

[Formation and Evaluation of Image]

By the following procedures, an image was formed on the print medium M, and thereafter, quality of the image was evaluated and durability of the charging roller 41 was evaluated. Table 2 describes results of the evaluations.

Figure 5:
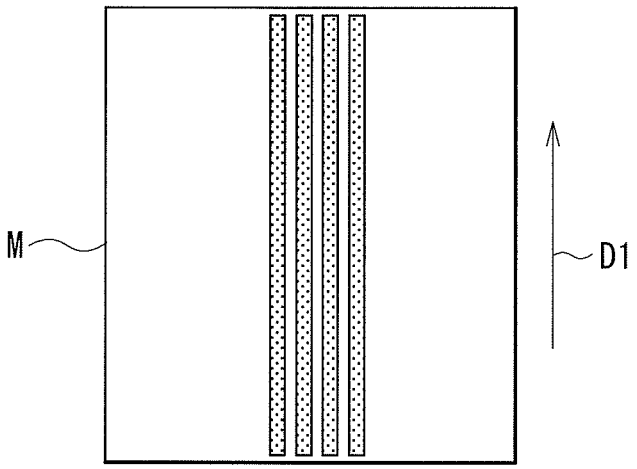
FIG. 5 is a plan view of an example of a configuration of a print medium at a time of successive image formation.
Figure 6:
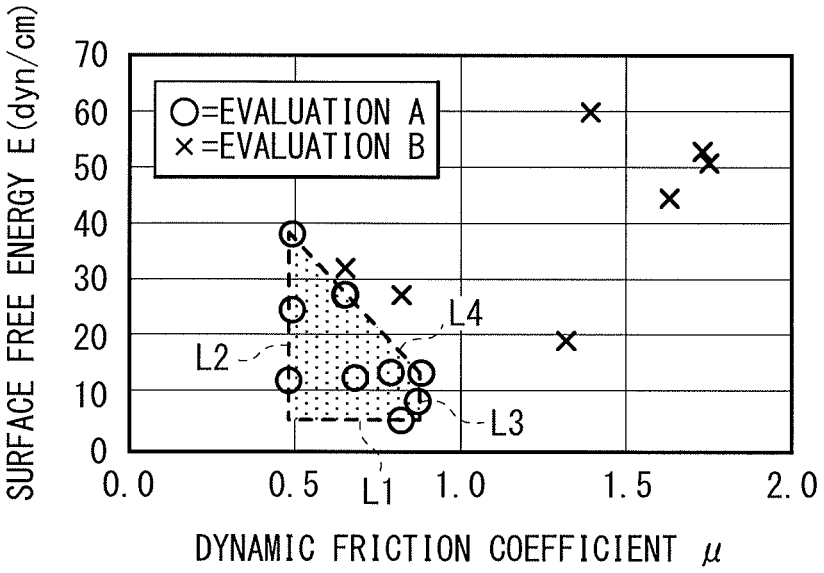
FIG. 6 is a diagram illustrating an example of a correlation between surface free energy, the dynamic friction coefficient, and quality of an image (an image defect occurrence state).

FIG. 5 illustrates a planar configuration of the print medium M at a time of successive formation of images in order to explain an image pattern at the time of the successive formation of the images. FIG. 6 illustrates a correlation between the surface free energy E, the dynamic friction coefficient μ, and quality of the image (image defect occurrence state.)

[Evaluation Procedure of Quality of Image]

In a case of evaluating quality of images, the images were first successively formed on the print medium M under ambient temperature and ambient humidity environmental conditions (at a temperature of 23±3° C. and humidity of 55±10% RH.) In this case, as illustrated in FIG. 5, images each including a four-stripe pattern of a printing rate of 5% was formed with use of the cyan toner while successively conveying the print media M with a longitudinal direction of the print media M of A4 size corresponding to the conveyance direction D1. Number of images to be formed per day was set within a range from 3500 to 4000, and in such a condition, the images were successively formed until total number of the formed images reached 50000.

When the above-described successive formation of images was performed, an image for evaluation was formed on the print medium M every day before the successive formation of images was performed, and an image for evaluation was formed on the print medium M every day also after the successive formation of images was performed. The image for evaluation had a halftone image pattern (a 2×2 pattern and a 1×1 pattern.)

Lastly, after the successive formation of the images was completed, the quality of the images was evaluated by visually observing the series of images for evaluation formed on the print media M. Specifically, a case was evaluated as "A" where no image defect occurred in any of the images for evaluation. A case was evaluated as "B" where an image defect occurred in any of the images for evaluation. In FIG. 6, data evaluated as "A" in Table 2 is represented by "○ (circle)", and data evaluated as "B" in Table 2 is represented by "× (cross)".

[Evaluation Procedure of Durability of Charging Roller]

In a case of examining the durability of the charging roller 41, after the above-described successive formation of the images was completed, the cleaning roller 42 was collected from the image forming apparatus and the surface 42M of the cleaning roller 42 was visually observed. A state, i.e., a smudge level, of the surface 42M was evaluated in five levels.

Specifically, in a case where little amount of the external additive was attached to the surface 42M, little amount of the external additive was attached to the surface 41M of the charging roller 41. It was therefore determined that the life of the charging roller 41 would be sufficiently longer. This case was evaluated as having the smudge level of "5." In a case where an extremely-small amount of the external additive was attached to the surface 42M, only an extremely-small amount of external additive was attached to the surface 41M. It was therefore determined that the life of the charging roller 41 would be longer. This case was evaluated as having the smudge level of "4."

In a case where a small amount of the external additive was attached to the surface 42M, only a small amount of the external additive was attached to the surface 41M. It was therefore determined that the life of the charging roller 41 would be slightly longer. This case was evaluated as having the smudge level of "3." In a case where the external additive was attached to the surface 42M, some amount of the external additive was attached to the surface 41M. It was therefore determined that the life of the charging roller 41 would be shorter. This case was evaluated as having the smudge level of "2." In a case where a great amount of the external additive was attached to the surface 42M, a great amount of the external additive was attached to the surface 41M. It was therefore determined that the life of the charging roller 41 would be remarkably shorter. This case was evaluated as having the smudge level of "1."

That is, in the above-described five-level evaluation result based on the smudge level, the greater value of the smudge level indicates that the external additive is hardly adsorbed to the surface 41M of the charging roller 41, or even if the external additive is adsorbed to the surface 41M of the charging roller 41, the cleaning roller 42 sufficiently removes the external additive, and the life of the charging roller 41 is therefore made longer.

[Discussion]

As described in Table 2 and illustrated in FIG. 6, the quality of the image (the image defect occurrence state) varied in accordance with the physical properties of the charging roller 41 and the cleaning roller 42, i.e., the surface free energy E, the dynamic friction coefficient μ, and the relation between the surface free energy E and the dynamic friction coefficient μ.) Specifically, as described in Table 2, no image defect occurred in a case where the three conditions were satisfied at the same time, i.e., the condition that the surface free energy E was 5.00 dyn/cm or more, the condition that the dynamic friction coefficient μ fell within the range from 0.48 to 0.88 both inclusive, and the condition that the surface free energy E and the dynamic friction coefficient μ satisfied the relation ($E \leq -63\mu+69$) represented by the expression (1) were satisfied at the same time (Experimental examples 1 to 9), unlike in a case where the three conditions were not satisfied at the same time (Experimental examples 10 to 16).

In FIG. 6, a range surrounded by dashed lines L1 to L4, i.e., a hatched region represents a range in which no image defect occurred. The dashed line L1 is a straight line representing the surface free energy E of 5.00 dyn/cm. The dashed line L2 is a straight line representing the dynamic friction coefficient μ of 0.48. The dashed line L3 is a straight line representing the dynamic friction coefficient μ of 0.88. The dashed line L4 is a straight line representing $y=-63\mu+69$ where "y" is the surface free energy E and "x" is the dynamic friction coefficient μ.

In particular, in the case where the above-described three conditions were satisfied at the same time, when the surface free energy E fell within a range from 5.00 dyn/cm to 13.49 dyn/cm both inclusive (Experimental examples 1 to 5 and 9), the smudge level was 5. Therefore, the external additive was hardly attached to the surface 42M of the cleaning roller 42. Accordingly, the external additive was hardly attached to the surface 41M of the charging roller 41, which made the life of the charging roller 41 sufficiently longer.

According to the results described in Table 2 and illustrated in FIG. 6, when the above-described three conditions related to the physical properties of the charging roller 41 and the cleaning roller 42, i.e., the surface free energy E, the dynamic friction coefficient μ, and the relation between the surface free energy E and the dynamic friction coefficient μ, were satisfied at the same time, the quality of the image was improved. As a result, a high-quality image was formed.

Although one embodiment of the technology has been described above with reference to some example embodiments, the embodiment of the technology is not limited to the above-described example embodiments.

For example, the image forming apparatus according to one embodiment of the technology is not limited to a color image forming apparatus. In one specific but non-limiting example, the image forming apparatus according to one embodiment of the technology may be a monochrome image forming apparatus. For example, the image forming apparatus according to one embodiment of the technology is not limited to a printer. In one specific but non-limiting example, the image forming apparatus according to one embodiment of the technology may be any other apparatus that forms an image such as a copier, a facsimile machine, or a multifunction peripheral. For example, the image forming apparatus according to one embodiment of the technology is not limited to that of a direct transfer method which uses no intermediate transfer medium. In one specific but non-limiting example, the image forming apparatus according to one embodiment of the technology may be that of an intermediate transfer method using the intermediate transfer print medium. Other than the above, for example, the charging device according to one embodiment of the technology is applicable to any application other than the image forming apparatus such as the printer.

Furthermore, the technology encompasses any possible combination of some or all of the various embodiments and the modifications described herein and incorporated herein. It is possible to achieve at least the following configurations from the above-described example embodiments of the technology.

[1]

A charging device including:

a charging member that electrically charges a surface of a charging target member and is rotatable while being in contact with the surface of the charging target member; and a cleaning member that is in contact with a surface of the charging member and removes a foreign object attached to the surface of the charging member, in which surface free energy of the surface of the charging member is 5.00 dynes per centimeter or more, a dynamic friction coefficient of the surface of the charging member and a surface of the cleaning member falls within a range from 0.48 to 0.88 both inclusive, and the surface free energy and the dynamic friction coefficient satisfy a relation represented by the following expression (1), $$E \leq -63\mu + 69 \quad (1)$$

where "E" is the surface free energy in dynes per centimeter, and "μ" is the dynamic friction coefficient.

[2]

The charging device according to [1], in which the surface free energy is 13.49 dynes per centimeter or less.

[3]

The charging device according to [1] or [2], in which the charging member includes a first surface layer having a surface that includes fluororesin.

[4]

The charging device according to [3], in which the first surface layer includes a mixture of epichlorohydrin rubber and acrylonitrile-butadiene rubber.

[5]

The charging device according to any one of [1] to [4], in which the cleaning member includes a second surface layer having a surface that includes foamed polyurethane.

[6]

An image former including:

a developing device that includes a photosensitive member serving as a charging target member and performs a developing process with use of a toner, and the charging device according to any one of [1] to [5], the charging device performing a charging process on a surface of the photosensitive member.

[7]

An image forming apparatus including:

the image former according to [6], the image former performing a charging process and a developing process, a transfer section that performs a transfer process with use of a toner subjected to the developing process by the image former; and a fixing section that performs a fixing process with use of the toner subjected to the transfer process by the transfer section.

According to any of the charging device, the image former, and the image forming apparatus of one embodiment of the technology, the surface free energy of the surface of the charging member in the charging device is 5.00 dyn/cm or more, the dynamic friction coefficient of the surface of the charging member and the surface of the cleaning member in the charging device falls within the range from 0.48 to 0.88 both inclusive, and the surface free energy and the dynamic friction coefficient satisfy the relation represented by the expression (1). Therefore, it is possible to form a high-quality image.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A charging device comprising:

a charging member that electrically charges a surface of a charging target member and is rotatable while being in contact with the surface of the charging target member; and a cleaning member that is in contact with a surface of the charging member and removes a foreign object attached to the surface of the charging member, wherein surface free energy of the surface of the charging member is 5.00 dynes per centimeter or more, a dynamic friction coefficient of the surface of the charging member and a surface of the cleaning member falls within a range from 0.48 to 0.88 both inclusive, and the surface free energy and the dynamic friction coefficient satisfy a relation represented by the following expression (1), $$E \leq -63\mu + 69 \quad (1)$$

where "E" is the surface free energy in dynes per centimeter, and "μ" is the dynamic friction coefficient.

2. The charging device according to claim 1, wherein the surface free energy is 13.49 dynes per centimeter or less.

3. The charging device according to claim 1, wherein the charging member includes a first surface layer having a surface that includes fluororesin.

4. The charging device according to claim 3, wherein the first surface layer includes a mixture of epichlorohydrin rubber and acrylonitrile-butadiene rubber.

5. The charging device according to claim 1, wherein the cleaning member includes a second surface layer having a surface that includes foamed polyurethane.

6. An image former comprising:

a developing device that includes a photosensitive member and performs a developing process with use of a toner; and a charging device that performs a charging process on a surface of the photosensitive member, the charging device including a charging member that electrically charges the surface of the photosensitive member and is rotatable while being in contact with the surface of the photosensitive member, and a cleaning member that is in contact with a surface of the charging member and removes a foreign object attached to the surface of the charging member, wherein surface free energy of the surface of the charging member is 5.00 dynes per centimeter or more, a dynamic friction coefficient of the surface of the charging member and a surface of the cleaning member falls within a range from 0.48 to 0.88 both inclusive, the surface free energy and the dynamic friction coefficient satisfy a relation represented by the following expression (1), $$E \leq -63\mu + 69 \quad (1)$$

where "E" is the surface free energy in dynes per centimeter, and "μ" is the dynamic friction coefficient.

7. An image forming apparatus comprising:

an image former that performs a charging process and a developing process, a transfer section that performs a transfer process with use of a toner subjected to the developing process by the image former; and a fixing section that performs a fixing process with use of the toner subjected to the transfer process by the transfer section, the image former including a developing device that includes a photosensitive member and performs a developing process with use of a toner; and a charging device that performs a charging process on a surface of the photosensitive member, the charging device including a charging member that electrically charges the surface of the photosensitive member and is rotatable while being in contact with the surface of the photosensitive member, and a cleaning member that is in contact with a surface of the charging member and removes a foreign object attached to the surface of the charging member, wherein surface free energy of the surface of the charging member is 5.00 dynes per centimeter or more, a dynamic friction coefficient of the surface of the charging member and a surface of the cleaning member falls within a range from 0.48 to 0.88 both inclusive, the surface free energy and the dynamic friction coefficient satisfy a relation represented by the following expression (1), $$E \leq -63\mu + 69 \quad (1)$$

where "E" is the surface free energy in dynes per centimeter, and "μ" is the dynamic friction coefficient.

* * * * *